US009136605B2

(12) United States Patent
Abe

(10) Patent No.: US 9,136,605 B2
(45) Date of Patent: Sep. 15, 2015

(54) ANTENNA DEVICE

(75) Inventor: Akira Abe, Yokohama (JP)

(73) Assignee: Honda Elesys Co., Ltd., Kanagawa (JP)

( * ) Notice: Subject to any disclaimer, the term of this patent is extended or adjusted under 35 U.S.C. 154(b) by 557 days.

(21) Appl. No.: 13/565,681

(22) Filed: Aug. 2, 2012

(65) Prior Publication Data

US 2013/0033404 A1 Feb. 7, 2013

(30) Foreign Application Priority Data

Aug. 2, 2011 (JP) ..... 2011-169303

(51) Int. Cl.

| | |
|---|---|
| ***H01Q 13/00*** | (2006.01) |
| ***H01Q 13/02*** | (2006.01) |
| ***H01Q 13/22*** | (2006.01) |
| ***H01Q 21/00*** | (2006.01) |
| ***H01Q 21/06*** | (2006.01) |

(52) U.S. Cl.

CPC ..... *H01Q 13/02* (2013.01); *H01Q 13/22* (2013.01); *H01Q 21/005* (2013.01); *H01Q 21/064* (2013.01)

(58) Field of Classification Search

CPC ..... H01Q 21/064; H01Q 13/02; H01Q 13/22
USPC ..... 343/786, 772
See application file for complete search history.

(56) References Cited

U.S. PATENT DOCUMENTS

| | | | | |
|---|---|---|---|---|
| 2,461,005 | A * | 2/1949 | Southworth | 342/6 |
| 2007/0001910 | A1* | 1/2007 | Yamanaka et al. | 343/700 MS |
| 2007/0139287 | A1* | 6/2007 | Inomata et al. | 343/786 |
| 2012/0218160 | A1* | 8/2012 | Montgomery et al. | 343/776 |

FOREIGN PATENT DOCUMENTS

| | | | |
|---|---|---|---|
| JP | 05-209953 | A | 8/1993 |
| JP | 2007-228313 | A | 9/2007 |
| JP | 2010-103806 | A | 5/2010 |

OTHER PUBLICATIONS

Tasuku Teshirogi et al., "New Millimeter Wave Technology", Nov. 25, 1999, pp. 112-119, Ohm Co., Ltd.

Takashi Hirano et al., "Altering-Phase Fed Single-Layer Slotted Waveguide Arrays with Chokes", The 2000 IEICE General Conference, B-1-134.

* cited by examiner

*Primary Examiner* — Dameon E Levi
*Assistant Examiner* — Ricardo Magallanes
(74) *Attorney, Agent, or Firm* — Keating & Bennett, LLP

(57) ABSTRACT

An antenna device includes antennas, each of which includes antenna elements arranged in a longitudinal direction, arranged side by side in a transverse direction intersecting the longitudinal direction, wherein an interval between the antennas arranged side by side in the transverse direction is approximately 2λ where λ is a free space wavelength corresponding to an operating frequency, and each of the antenna elements includes a horn formed therein.

8 Claims, 13 Drawing Sheets

ANTENNA DEVICE

CROSS-REFERENCE TO RELATED APPLICATIONS

Priority is claimed on Japanese Patent Application No. 2011-169303, filed Aug. 2, 2011, the contents of which are entirely incorporated herein by reference.

BACKGROUND OF THE INVENTION

1. Field of the Invention

The present invention relates to an antenna device which can be used in an on-vehicle radar device for monitoring the driving direction of cars.

2. Background Art

An on-vehicle radar device has a radar function using millimeter waves, for example, and improves the driving safety of a car, so the development of a device with higher performance and lower price is under way for its dissemination. Such an on-vehicle radar device performs digital beam forming (DBF), for example.

The radar device performing DBF includes a plurality of columns of receiving antennas arrayed in the transverse direction and generates scanning beams by converting receiving signals from each receiving antenna into digital data, a giving phase difference to each receiving signal equivalently by arithmetic processing, and synthesizing the receiving signals. The radar device does not need driving parts or operating mechanisms, and can scan beams at a high speed and with a high degree of precision.

A field of view of about 20° in the transverse direction is necessary to monitor preceding cars or intercepting cars on the own driving lane or the adjacent lane in front. As a radar antenna, the waveguide slot array antenna can form beam characteristics of a fan shape suitable for this, and further a high gain is obtained since the reduction in power supply is small. The whole of this antenna is composed of a metal flat plate, so it has characteristics suitable to a small on-vehicle radar device, such as almost no performance variation or deformation due to heat and the ability to obtain a heat radiation function or the like.

Here, a conventional waveguide slot array antenna is disclosed, for example, in JP-A-2010-103806. The outline and principle are described in pp. 112 to 119 of "New Millimeter Wave Technology" written and edited by Tasuku Teshirogi/Tsukasa Yoneyama, Nov. 25, 1999, Ohm Co., Ltd.

The waveguide slot array antenna is a traveling-wave antenna which can obtain a high gain by forming a plurality of slots on the wall surface of sufficiently long waveguides and arranging the waveguides periodically such that the phases of the electric fields radiating sequentially from each slot match one another in a predetermined direction. By having the radiation electric fields of the respective slots match one another, a main beam is obtained in the straight direction with respect to the antenna surface (the waveguide wall surface having slots).

In a high gain single beam antenna used in communications or the like, a plurality of linear arrays are arranged in the transverse direction and power is supplied thereto such that the radiation electric fields of all slots become the same phase by a power supplying waveguide.

As a general structure, a simple manufacturing method, in which a metal thin plate (a slot plate) which has slots punched therein is placed on a metal flat plate (a base) which has waveguide slots processed therein and the peripheries of the plates are screw-fixed, is known.

Here, it is difficult to dispose a partition for separating waveguides and the slot plate without having any gap therebetween; however, a method of suppressing the leakage of radio wave between waveguides by supplying power to the neighboring linear array in a reverse phase is known. This method is to offset by making the wall surface current flow backward on both sides of the partition; therefore, it is very effective in a plane array antenna using a plurality of linear arrays. However, the offsetting effect cannot be obtained from the outermost waveguide, and other measures are necessary. For instance, forming choke grooves on the periphery is disclosed in "The 2000 IEICE General Conference, B-1-134".

SUMMARY OF THE INVENTION

Although a detailed description will be made later, in an on-vehicle radar device performing DBF, the preferable interval between the receiving antennas is approximately 2λ, where λ is a free space wavelength corresponding to the operating frequency.

In the case of using a conventional slot array, the receiving antennas are considered to be composed using two or three linear arrays as one set.

FIG. 8A is a front view showing the structure of an antenna device installed in a radar device in the case of using the conventional slot array, and FIG. 8B is a transverse cross-sectional view taken along the cutting line V-V in the transverse direction in FIG. 8A. This example shows the structure in which the receiving antennas are composed using two linear arrays as one set.

This antenna device includes a base plate 101 on which a plurality of waveguide grooves 111 separated by partitions 113 and 114 are formed, and a slot plate 102 which is overlapped on the base plate 101 to close the waveguide grooves 111, and in which slots 112 that communicate with respective waveguide grooves 111 are punched.

In addition, in this antenna device, the waveguide grooves 111 are closed by the slot plate 102, so that hollow waveguides 103 are formed.

Furthermore, FIGS. 8A and 8B show a long side width Wa1 (the transverse width in the present embodiment) of the waveguide 103 that is the width of the waveguide groove 111, an interval P1 between the receiving antennas, an interval D (the transverse interval between the neighboring waveguides 103), and a longitudinal interval λg/2 between the slots 112 that are near in the longitudinal direction perpendicular to the transverse direction.

Here, λg is the wavelength in the waveguide 103.

If power with opposite-phase is applied to the waveguides 103 that form a pair (the power supply of + and − shown in FIG. 8B), the leakage of radio wave in the antenna is suppressed even if the coupling of the waveguide wall surfaces (partitions 113 and 114) and the slot plate 102 is loose.

However, between adjacent antennas, each receiving wave is a separate signal even if the frequency is the same, the offsetting effect of the wall surface current is not obtained, and it is difficult to prevent leakage.

In a radar device, especially the radar device performing DBF, detection performance is greatly lowered if the phase is disturbed by the interference between receiving signals, so it is especially necessary to suppress leakage interference.

In consideration of the above-mentioned circumstances, it is an object of the present invention to provide a high-efficiency antenna device suitable as an on-vehicle radar device.

(1) In order to accomplish the above object, according to an aspect of the present invention, there is provided an antenna device including: antennas, each of which includes antenna elements arranged in a longitudinal direction, arranged side by side in a transverse direction intersecting the longitudinal direction, wherein an interval between the antennas arranged side by side in the transverse direction is approximately 2λ where λ is a free space wavelength corresponding to an operating frequency, and each of the antenna elements includes a horn formed therein.

(2) In the antenna device according to the above (1), the horn may have a shape expanding, while including a bent portion, in an extending direction of a long side of a slot formed in a waveguide.

(3) In the antenna device according to the above (2), the horn may have a shape expanding, while including only one bent portion, in the extending direction of the long side of the slot formed in the waveguide, and the shape of the horn may be a pyramid.

(4) In the antenna device according to any one of the above (1) to (3), a transverse width of a bottom portion of a slot side of the horn may be greater than or equal to 1.5λ.

(5) In the antenna device according to any one of the above (1) to (4), a long side width of a waveguide may be less than 1λ.

(6) In the antenna device according to any one of the above (1) to (4), a long side width of a waveguide may be greater than or equal to 1λ and less than 1.5λ.

(7) In the antenna device according to any one of the above (1) to (6), the antenna may be a receiving antenna.

(8) In the antenna device according to any one of the above (1) to (6), the antenna may be a transmitting antenna.

(9) In order to accomplish the above object, according to another aspect of the present invention, there is provided an antenna device including: one or more rows of transmitting antennas and a plurality of rows of receiving antennas arranged side by side in a transverse direction, wherein each of the transmitting antennas is configured by arranging antenna elements, each of which includes a horn formed therein, in a longitudinal direction intersecting the transverse direction, each of the receiving antennas is configured by arranging antenna elements, each of which includes a horn formed therein, in the longitudinal direction, and an interval between the receiving antennas arranged side by side in the transverse direction is approximately 2λ where λ is a free space wavelength corresponding to an operating frequency.

(10) In the antenna device according to the above (9), a shape of the transmitting antenna may be different from the shape of the receiving antenna.

As described above, according to the various aspects of the present invention, it is possible to provide a high-efficiency antenna device used in the on-vehicle radar device.

BRIEF DESCRIPTION OF THE DRAWINGS

FIGS. 2A to 2D are views showing the structure (the stereoscopic structure) of the antenna device installed in the on-vehicle radar device according to the embodiment of the present invention, wherein FIG. 2A is a front view, FIG. 2B is a transverse cross-sectional view taken along the cutting line I-I in the transverse direction in FIG. 2A, FIG. 2C is a longitudinal cross-sectional view taken along the cutting line II-II in the longitudinal direction perpendicular to the transverse direction in FIG. 2A, and FIG. 2D is a rear view as seen in the longitudinal direction along the arrow III in FIG. 2B.

DETAILED DESCRIPTION OF THE INVENTION

Figure 1:
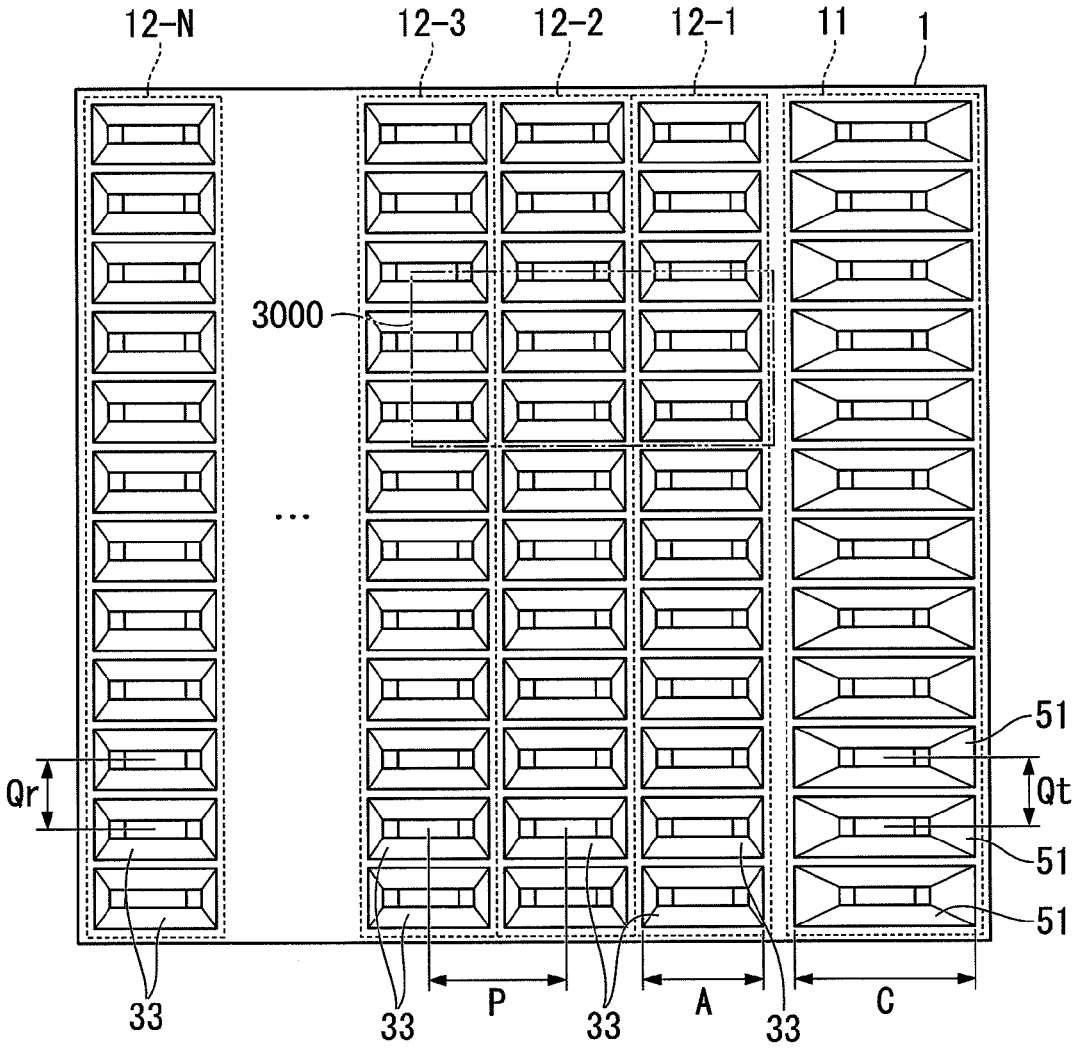
FIG. 1 is a front view showing the structure of an antenna device installed in an on-vehicle radar device according to an embodiment of the present invention.

FIG. 1 is a front view showing the structure of an antenna device (a radar antenna 1) installed in an on-vehicle radar device according to an embodiment of the present invention.

In the present embodiment, the arrangement and configuration of the antenna device (the radar antenna 1) installed in the radar device performing DBF is shown.

Figure 2A:
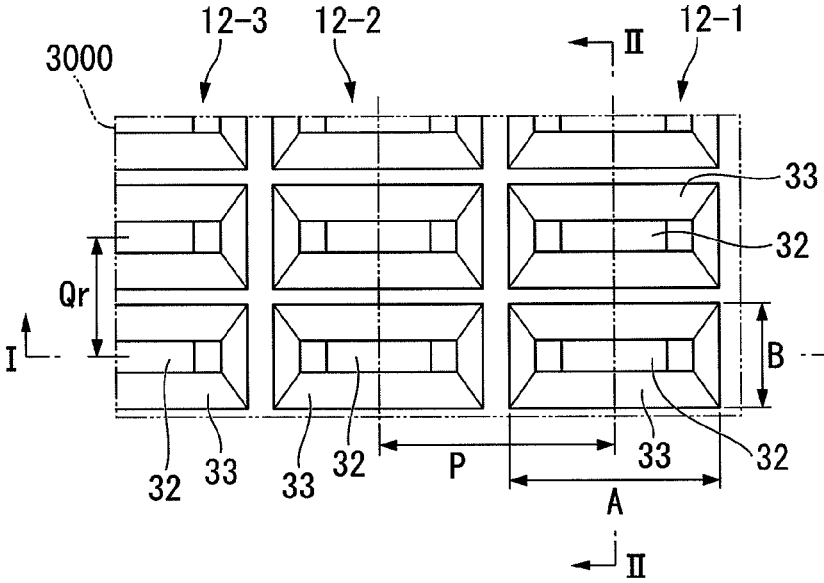
Figure 2C:
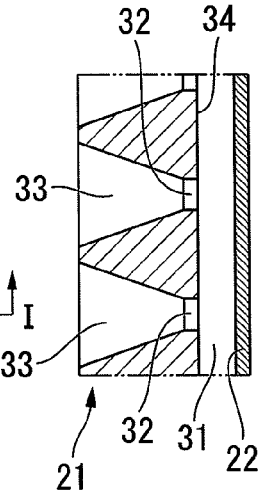
Figure 2B:
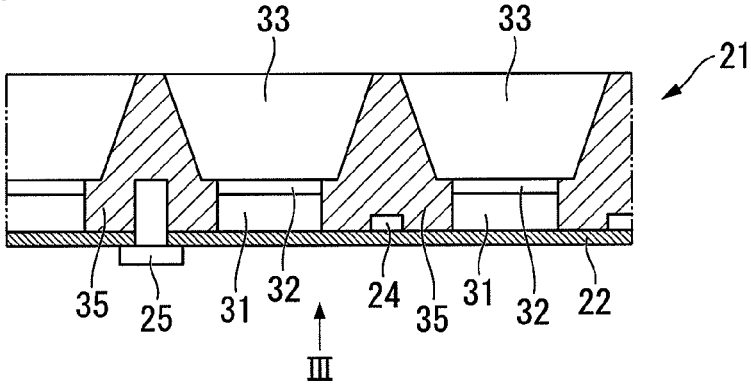
Figure 2D:
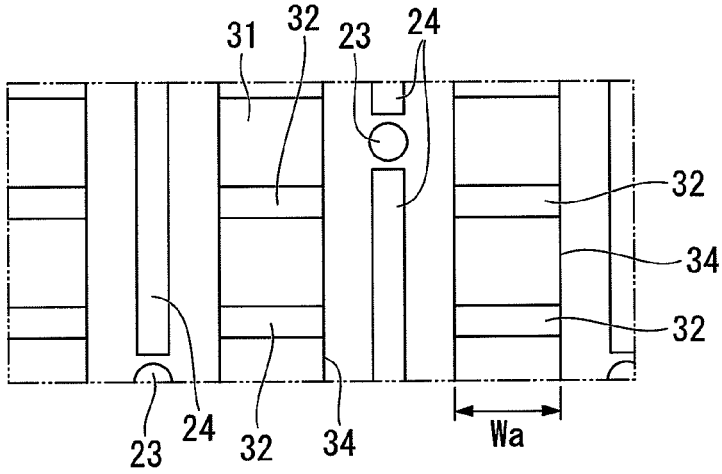

FIGS. 2A to 2D are views showing the structure (the stereoscopic structure) of the antenna device installed in the on-vehicle radar device according to the embodiment of the present invention. FIG. 2A is a front view of the scope 3000 of a section surrounded by a two-dot chain line shown in FIG. 1, FIG. 2B is a transverse cross-sectional view taken along the cutting line I-I in the transverse direction in FIG. 2A, FIG. 2C is a longitudinal cross-sectional view taken along cutting line II-II is the longitudinal direction perpendicular to the transverse direction in FIG. 2A, and FIG. 2D is a rear view of the metal plate 22 seen in the height direction along the arrow III in FIG. 2B.

Meanwhile, this example shows the structure of N (N is a plural value) columns of receiving antennas 12-1 to 12-N, but also for a transmitting antenna 11, the same structure as either one of the receiving antennas 12-1 to 12-N (that is, the structure of one column) can be used even though the dimensions may be different.

Here, the antenna device installed in the on-vehicle radar device according to the embodiment of the present invention is installed in the front of a vehicle such as an automobile, for example, in such a way that the transverse direction of the antenna device is the transverse direction of the vehicle (a substantially horizontal (left and right) direction when the vehicle is on the ground), and the longitudinal direction of the antenna device is the longitudinal direction of the vehicle (a substantially vertical (up and down) direction when the vehicle is on the ground).

With reference to FIGS. 1, 2A to 2D, and 3A to 3C, the structure of the antenna device (the radar antenna 1) installed in the on-vehicle radar device according to the present embodiment will be described.

As shown in FIG. 1, the radar antenna 1 includes one column of transmitting antenna 11 in which a plurality of antenna elements are arranged in the longitudinal direction, and N columns of receiving antennas 12-1 to 12-N installed in which a plurality of antenna elements are arranged in the transverse direction.

The receiving antennas 12-1 to 12-N are arranged side by side in the transverse direction at transverse intervals P (the transverse intervals of horns 33, rectangular waveguides 31, and slots 32) of the same receiving antennas.

One column of transmitting antennas 11 is the number of rows of antenna elements arranged at the same intervals Qt in the longitudinal direction (the number of longitudinal arrays of horns 51) and has 12 rows in the longitudinal direction.

One column of receiving antennas 12-1 to 12-N is the number of rows of antennas arranged at the same intervals Qr in the longitudinal direction (the number of longitudinal arrays of horns 33) and has 12 rows in the longitudinal direction.

As shown in FIGS. 2A to 2D, the radar antenna 1 includes an antenna plate 21 and a metal plate 22 disposed on the back surface of the antenna plate 21.

The antenna plate 21 has waveguide grooves 34 which are opened toward the back surface and extended in the longitudinal direction so as to have a substantially rectangular cross section, horns 33 which are formed on the front surface of the waveguide grooves 34 and opened toward the front surface of the antenna plate 21, and slots 32 communicating with the horns 33 and the waveguide grooves 34.

Tap holes 23 and choke grooves 24 which extend to the longitudinal opposite sides of the tap holes 23 are formed on the back surface of the antenna plate 21. The metal plate 22 is fixed to the back surface of the antenna plate 21 by bolts 25 screw-joined to the tap holes 23.

The waveguide grooves 34 are closed by the metal plate 22, and thereby rectangular waveguides 31 having a substantially rectangular cross section are formed. The rectangular waveguides 31 (the waveguide grooves 34) are extended in the longitudinal direction and formed in the transverse direction at a plurality of intervals.

The horns 33 and slots 32 are formed in the longitudinal direction at a plurality of intervals corresponding to the rectangular waveguides 31.

Meanwhile, in the present embodiment, the case of using the waveguide (the rectangular waveguide 31) having a rectangular shape is shown, but a waveguide having a different shape may be used.

In the present embodiment, as the horn 33, a pyramid horn having a bent cross section is used.

Specifically, the horn 33 is formed in a horn shape so that a back bottom portion 33*b* is reduced with respect to a front aperture portion 33*a*. The aperture portion 33*a* and the bottom portion 33*b* are formed in a substantially rectangular shape having a long side in the transverse direction and a short side in the longitudinal direction. The long side and the short side of the aperture portion 33*a* are set larger than the long side and the short side of the bottom portion 33*b*.

The slot 32 is also formed with the cross section in a substantially rectangular shape. The long side in the transverse direction of the slot 32 is set smaller than the long side of the bottom portion 33*b* of the horn 33. Furthermore, the short side in the longitudinal direction of the slot 32 is set substantially the same as the short side of the bottom portion 33*b* of the horn 33. In addition, the bottom portion 33*b* of the horn 33 has a plane substantially parallel to the front and back surfaces of the antenna plate 21 on transverse opposite sides of the slot 32, and the end portion of the bottom portion 33*b* is a bent portion 33*c*, so that a horn having a bent cross section is formed.

Accordingly, in the present embodiment, each of the receiving antennas 12-1 to 12-N has the slot 32 perpendicular to the lengthwise direction of the waveguide on the long side surface of one rectangular waveguide 31, and each horn 33 is formed in one of the slots 32 (in the present embodiment, this is added.)

These slots and holes are integrated with the antenna plate 21 as a single unit. Therefore, a hollow structure of the rectangular waveguide 31 is made by placing the metal plate 22 on the face (back surface) of the waveguide groove 34 with respect to the aperture (radiation plane) of the horn 33 and closely fixing them by the bolt 25.

The rear view of FIG. 2D is of the antenna plate 21 as seen from the back surface, and the tap hole 23 through which the bolt 25 passes and the choke groove 24 are formed likewise by integral processing.

FIG. 2A shows a transverse width (an aperture width) A that is the length of the long side in the aperture portion 33*a* of the horn 33, a longitudinal width B that is the length of the short side in the aperture portion 33*a*, a transverse interval between the receiving antennas 12-1 to 12-N (a transverse interval between the horns 33, the rectangular waveguides 31, and the slots 32) P, and a longitudinal interval between the receiving antennas 12-1 to 12-N (a longitudinal interval between the horns 33 and the slots 32) Qr, and FIG. 2D shows a long side width of the rectangular waveguide 31 (a transverse width in the present embodiment) Wa.

Because the long side width (the transverse width) Wa of the rectangular waveguide 31 with respect to interval 2λ on the back surface is usually less than 1λ, a wide partition 35 remains between the neighboring rectangular waveguides 31.

For example, there is a clearance of about 4 mm in the 76-GHz band, and an adherent state can be obtained by disposing bolts 25 with a diameter of about 3 mm at important points.

However, the long side width (the transverse width) Wa of the rectangular waveguide 31 may have another configuration.

Furthermore, by using the choke groove 24 simultaneously, it is possible to block leakage reliably even with a smaller number of bolts.

Furthermore, in the present embodiment, the built-up bolt 25 is installed behind the radiation plane, the outer frame structure for providing a margin of the choke groove or bolt on the outer circumference of the device is not necessary, and the device area can be made with the minimum dimensions that are substantially the same as the area required for radiation.

The antenna device (the radar antenna 1) installed in the radar device according to the present embodiment has characteristics suitable to the radar device performing DBF even in terms of antenna performance.

Next, various dimensions will be described.

The longitudinal interval Qt between the horns 51 of the transmitting antennas 11 and the longitudinal interval Qr between the horns 33 of the respective receiving antennas 12-1 to 12-N are equal (set Qt=Qr=Q), and by making the transverse interval Q between the horns equal to the wavelength λg of the rectangular waveguides 31, power with an equal phase is supplied to each horn.

Here, the wavelength λg of the rectangular waveguides 31 is shown by equation (1) with respect to the long side width Wa of the rectangular waveguides 31.

$$\lambda g=(1/\lambda^2-\tfrac{1}{4}Wa^2)^{-1/2} \quad (1)$$

Here, λ is a free space wavelength corresponding to the operating frequency, and in the 76-GHz band used in an on-vehicle millimeter wave radar, it is 3.92 mm in 76.5 GHz. When Wa=3.6 mm, λg is 4.67 mm and the longitudinal width B is about 4 mm.

Meanwhile, in the present embodiment, the transverse width (the aperture width) C of the horn 51 of the transmitting antenna 11 is greater than or equal to 3λ, but as another example, a configuration with a value greater than or equal to (and less than 3λ) the transverse width (the aperture width) A of the horn 33 of the receiving antennas 12-1 to 12-N may be used.

For radar performance, high resolution is required to separate and detect the preceding cars on the own driving lane or adjacent lane, for example. For this reason, it is preferable that the scanning beam be as narrow as possible.

The DBF beam width is inversely proportional to the product of the number of columns N of the receiving antennas 12-1 to 12-N and the interval P on the whole, but as the number of columns (N) of the receiving antennas increases, the scale of the receiving system such as the receiver and the signal converter increases, and the device is expensive and large.

Meanwhile, if the antenna interval is excessively large, a grating lobe becomes a problem.

If a visual field angle of radar (a detection range) is ω° horizontal with respect to a straight direction of the antenna plane (0°), then the grating lobe appears in the range of $\sin^{-1}[\iota\lambda/P\pm\sin(\omega)]$ (ι=1, 2, . . . ).

If ω=10°, and the interval P is larger than 2.88λ, the grating lobe appears within the visual field angle, so it is difficult to distinguish it from the scanning beam and specify the azimuth of the incoming wave.

Accordingly, it is considered appropriate to select approximately 2λ (preferably 1.5λ to 2.5λ) for the interval P between the receiving antennas 12-1 to 12-N in the on-vehicle radar device.

For example, if P=2λ, the grating lobe appears to be in the range of 19° to 42° and 56° to 90°. If there is a strong incoming wave from this direction, it is falsely detected to be in the front direction, so it is necessary to suppress the side lobe level of the appearance angle range of the grating lobe in the transmitting and receiving orientation characteristics of the radar antenna.

Figure 3A:
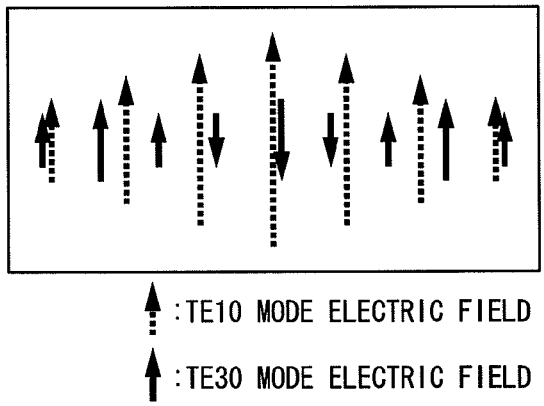
FIG. 3A is a view showing an electric field of an aperture plane of a horn.
Figure 3B:
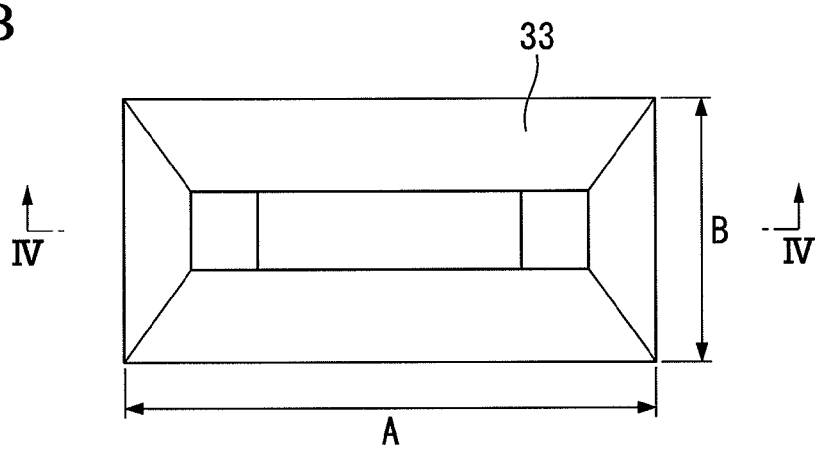
FIG. 3B is a front view (radiation plane) of the horn.
Figure 3C:
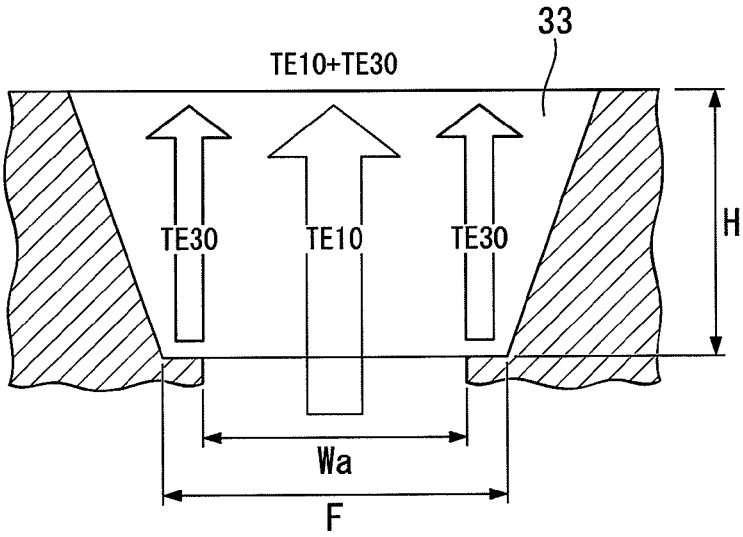
FIG. 3C is a transverse cross-sectional view of the horn taken along the cutting line IV-IV in the transverse direction in FIG. 3B.

FIGS. 3A to 3C are views for describing the structure and principle of the horn 33 (in the present embodiment, the horn having a bent cross section) of the antenna device installed in the on-vehicle radar device according to the embodiment of the present invention.

FIG. 3A is a view showing the electric field of the aperture plane of the horn 33, FIG. 3B is a front view (radiation plane) of the horn 33, and FIG. 3C is a transverse cross-sectional view of the horn 33 taken along the cutting line IV-IV in the transverse direction in FIG. 3B.

Here, the transverse cross-sectional view of the horn 33 of FIG. 3C shows the propagation and generation of each mode (TE10 mode electric field and TE30 mode electric field). Furthermore, it shows the long side width of the rectangular waveguide 31 (in the present embodiment, the transverse width) Wa, the transverse width F of the bottom portion 33*b* of the horn 33, and the depth of the horn 33 (in the present embodiment, the length of the height direction) H.

The horn 33 has the bottom portion 33*b* near the slot 32 with a transverse width F of greater than or equal to 1.5λ (and preferably less than 2λ) in the extending direction of the long side (in the present embodiment, in the transverse direction) and a discontinuously expanded shape including the bent portion 33*c* in the extending direction of the long side of the slot 32 (in the present embodiment, the dimensions of the long side of the slot 32 is equal to the long side width Wa of the rectangular waveguide 31). Therefore, the horn corrects the radiation characteristics using the generating higher mode.

Usually, the dimension of the waveguide is determined such that only a single mode is transmitted. In the rectangular waveguide 31, if the long side is λ/2 to less than 1λ, and the short side is less than λ/2 (and preferably λ/10 or more), only the TE10 mode is transmitted. This is called a main mode.

Here, if the long side of the waveguide is greater than 1λ, the TE20 mode can be transmitted; if it is greater than 1.5λ (and preferably less than 2λ), the TE30 mode can be transmitted.

As illustrated in FIG. 3A showing the electric field of the aperture plane of the horn 33, in the present embodiment, the horn 33 generates the TE30 mode in the discontinuous portion including the bent portion 33*c* of the bottom portion 33*b*, and the electric field distribution in which the electric field of the TE10 mode and the electric field of the TE30 mode are combined is observed on the radiation aperture plane.

The view showing the electric field of the aperture plane of the horn 33 in FIG. 3A shows the electric field direction and distribution aspect of both of the mode components in the aperture plane of the horn 33.

Figure 4:
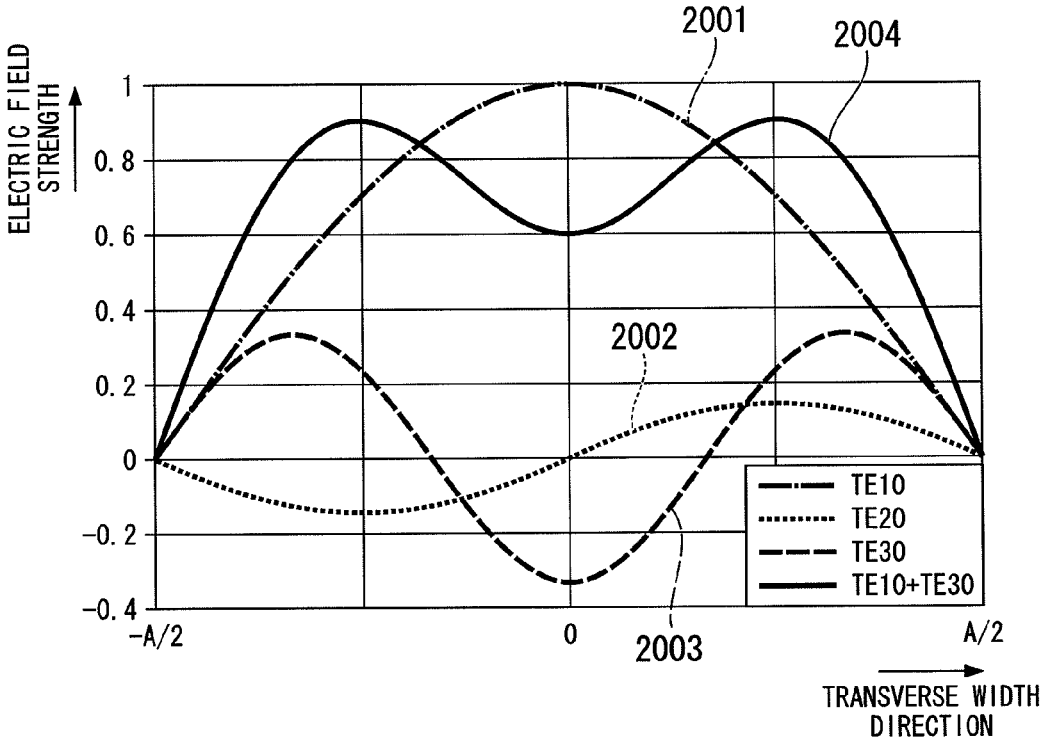
FIG. 4 is a view showing the electric field distribution of each mode.

FIG. 4 is a view showing the electric field distribution of each mode.

The transverse axis in the graph represents the transverse width direction of the transverse aperture width A of the horn 33 (−A/2 to A/2 with the center position being 0), and the longitudinal axis of the graph shows the electric field strength. Thereby, the computation examples of the electric field strength of the aperture are shown with the transverse axis as the transverse width direction.

Specifically, the electric field strength distribution 2001 of the TE10 mode, the electric field strength distribution 2002 of the TE20 mode, the electric field strength distribution 2003 of the TE30 mode, and the electric field strength distribution 2004 of the electric field in which the electric field of the TE10 mode and the electric field of the TE30 mode are combined (TE10 mode+TE30 mode), are shown.

As shown in FIG. 4, the ratio of the electric field of the TE10 mode and the TE30 mode is 3:1, and when the electric field direction at the center is opposite, the efficiency is highest and a gain increase of 0.5 dB is obtained compared with the case of a single TE10 mode.

Here, the generation amount and relative phase of the TE30 mode can be adjusted by choosing the transverse width F of the bottom portion 33*b* of the horn 33, the transverse aperture width A of the horn 33, and the dimension of the depth H of the horn 33. This adjustment can be made by detecting the shape of the radar lobe while the setter views the shape of the side lobe of the radar on the screen.

Meanwhile, the TE20 mode may exist as well, but as shown in FIG. 4, it has a left and right asymmetrical electric field distribution. Therefore, it occurs only when there is large left-to-right asymmetry, and it was confirmed through tests that it can be ignored if symmetry is maintained at a degree of precision of about 0.1 mm even in the 76-GHz band.

Here, although the TE10 mode, TE20 mode and TE30 mode are shown, any mode of a higher dimension may be used. However, a mode of a higher dimension is low in level, so it is considered preferable to use the TE10 mode and TE30 mode in most cases.

Figure 5:
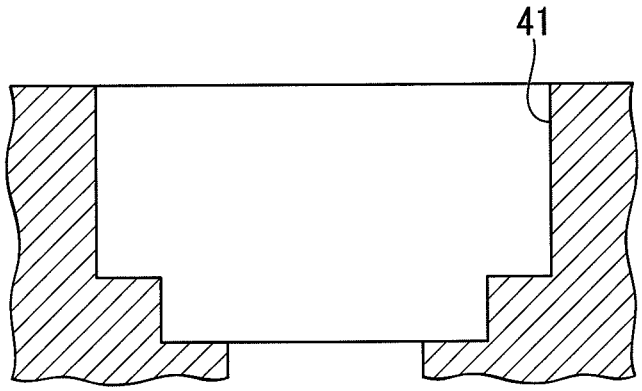
FIG. 5 is a transverse cross-sectional view showing an example of a horn having another structure.

FIG. 5 is a transverse cross-sectional view showing an example of a horn 41 having another structure.

The horn 41 with a bent cross section according to this example is of a multistage structure (two stages in this example), and has a discontinuously expanded shape through the bent cross section.

Specifically, the horn 41 of the present modified example includes a first part 41*a* opened toward the front surface and a second part 41*b* formed at the back side section as seen from the first part 41*a*, and the boundary of the first part 41*a* and the second part 41*b* is a bent portion 41*c*.

In the horn 41 of the present modified example, the first part 41*a* has a substantially rectangular cross section, and is formed of the same cross section toward the back surface from the front surface. Furthermore, the second part 41*b* has a substantially rectangular cross section, and is formed of the same cross section toward the back surface from the front surface. The second part 41*b* has the size of the rectangular cross section formed smaller than the first part 41*a*, and communicates with the first part 41*a*. An end portion having a plane substantially parallel to the front and back surfaces is formed at the bottom portion of the first part 41*a* that communicates with the second part 41*b*. Furthermore, the second part 41*b* communicates with a slot 32A, and the size of the rectangular cross section is formed larger than the slot 32A. In addition, an end portion having a plane substantially parallel to the front and back surfaces is also formed at the bottom portion of the second part 41*b* that communicates with the slot 32A.

Figure 6:
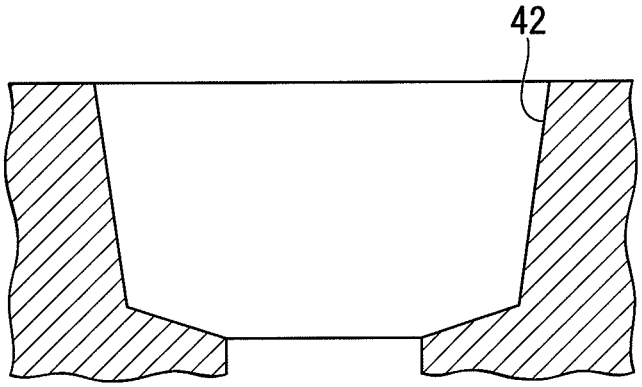
FIG. 6 is a transverse cross-sectional view showing an example of a horn having another structure.

FIG. 6 is a transverse cross-sectional view showing an example of a horn 42 having another structure.

The horn 42 with a bent cross section according to this example is of a multistage structure (two stages in this example), and has a shape that expands in a tapered shape.

In other words, the horn 42 of the present modified example also has a first part 42*a* opened toward the front surface and a second part 42*b* that extends toward the back surface from the first part 42*a* and communicates with a slot 32B, and the boundary between the first part 42*a* and the second part 42*b* is a bent portion 42*c*. The first part 42*a* and the second part 42*b* are formed so as to be inclined from outside to inside as the side wall goes from the front surface to the back surface, and the inclined angles thereof are different from each other.

Figure 7:
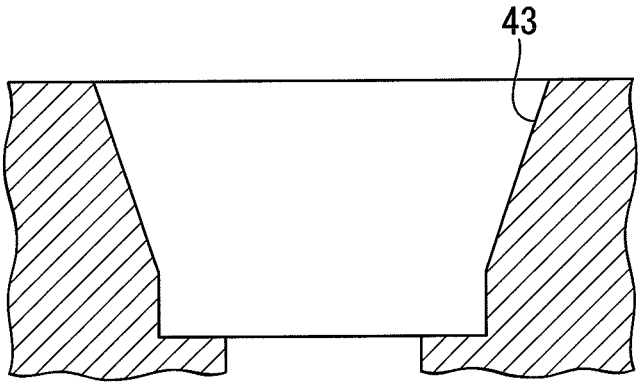
FIG. 7 is a transverse cross-sectional view showing a horn having still another structure.

FIG. 7 is a transverse cross-sectional view showing an example of a horn 43 having still another structure.

The horn 43 with a bent cross section according to this example is of a multistage structure (two stages in this example).

The horn 43 of the present modified example also has a first part 43*a* opened toward the front surface and a second part 43*b* that extends toward the back surface from the first part 43*a* and communicates with a slot 32C, and the boundary between the first part 43*a* and the second part 43*b* is a bent portion 43*c*. The first part 43*a* has the cross section formed in a tapered shape. Furthermore, in the second part 43*b*, the bottom portion communicating with the slot 32C is formed on a plane substantially parallel to the front and back surfaces.

The shape of the horn 43 according to this example is a shape that looks like a combination of the shape of the end portion of the horn 41 shown in FIG. 5 and the shape of the tapered portion of the horn 42 shown in FIG. 6.

As the cross-sectional shape of a horn with the bent cross section, a variety can be considered, such as the multistage configuration of step shapes as shown in FIG. 5, the tapered shape as shown in FIG. 6, or the combination shape thereof as shown in FIG. 7 or the like, but the same operation can be obtained by having a discontinuous portion including a bent portion with a width of 1.5λ or more.

Therefore, the aperture dimension of a horn with the bent cross-section provides the effect if the transverse width (the aperture width) A is greater than or equal to approximately 2λ.

In FIGS. 1 to 3C and 5 to 7, several examples are shown as the shape of a horn with the bent cross section, but various shapes besides those having a discontinuous portion (a bent portion) may be used.

As an example, shapes other than the rectangular cross section such as a hexagonal cross section may be used.

Furthermore, as another example, not only the shape of the cross section surrounded by a straight line like a rectangular cross section, but also other shapes having a partially or wholly curved cross section such as a partially circular cross section or a partially elliptical cross-section may be used.

Meanwhile, using a straight cross-sectional shape rather than the curved cross-sectional shape usually has an advantage in that manufacture is easier.

Furthermore, as the number of stages of a horn with the bent cross section, a configuration of two or more stages rather than one stage may be used. However, having fewer stages is considered preferable in order to realize smaller products and lower prices.

Next, the radiation characteristics that can be obtained by the antenna device installed in the on-vehicle radar device according to the embodiment of the present invention will be shown in comparison with the antenna device including the conventional slot array.

Figure 8A:
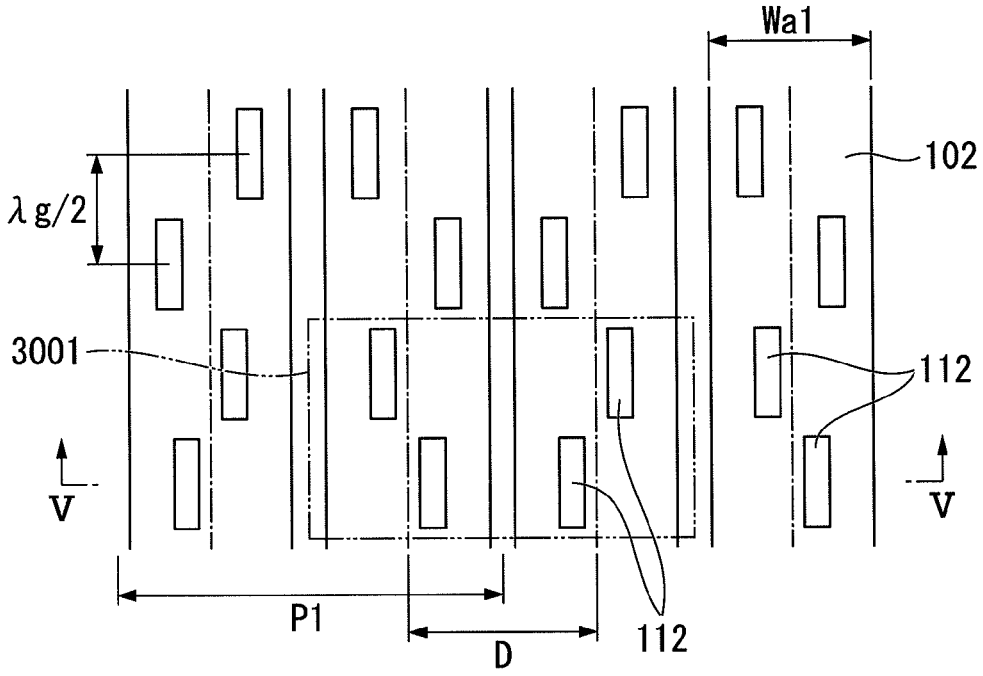
FIG. 8A is a front view showing the structure of an antenna device installed in a radar device in the case of using a conventional slot array.
Figure 8B:
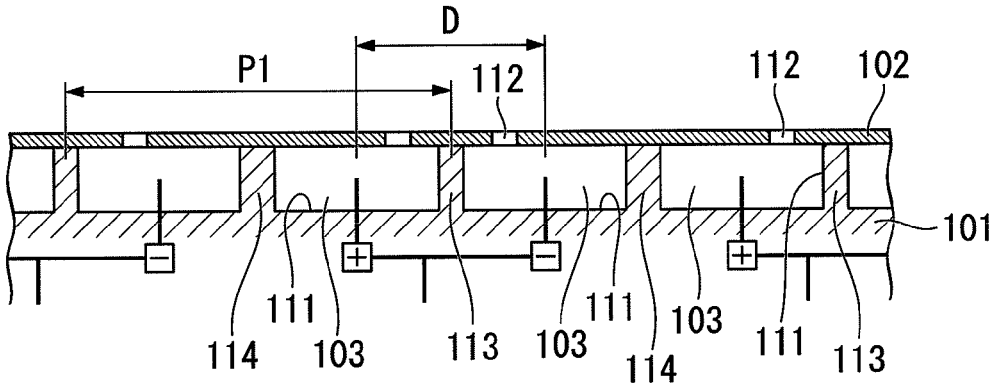
FIG. 8B is a transverse cross-sectional view taken along the cutting line V-V in the transverse direction in FIG. 8A.

Here, the antenna device installed in the on-vehicle radar device according to the embodiment of the present invention is shown in FIGS. 1 and 2A to 2D, and the antenna device including the conventional slot array is shown in FIGS. 8A and 8B.

Figure 9:
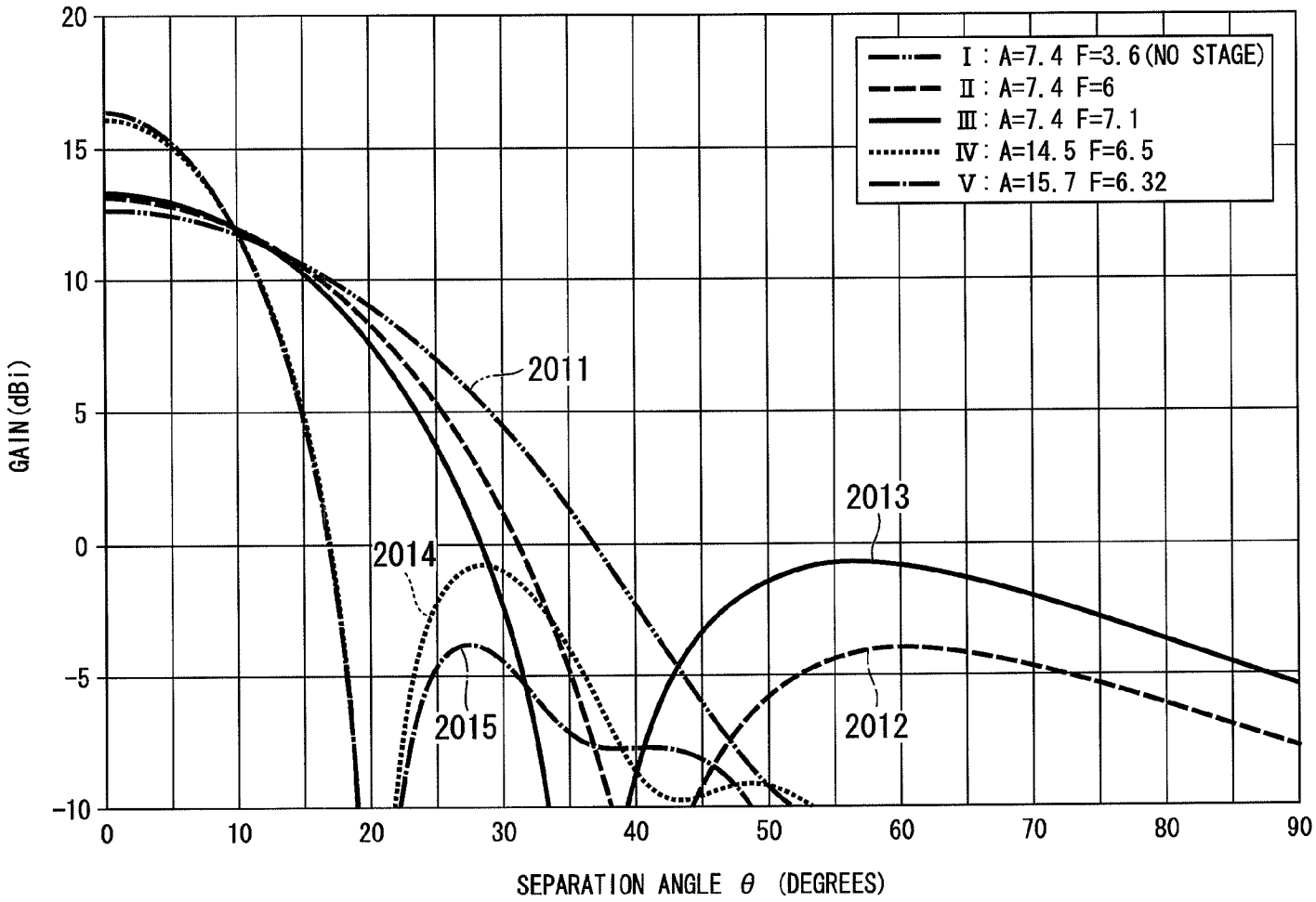
FIG. 9 is a view showing the radiation orientation characteristics (the antenna characteristics) of the transverse plane of a horn having a bent cross section.

FIG. 9 is a view showing the radiation orientation characteristics (the antenna characteristics) of the transverse plane of the horn 33 with the bent cross section provided in the antenna device installed in the on-vehicle radar device according to the embodiment of the present invention. The transverse axis represents the separation angle θ (degrees) from the center and the longitudinal axis represents the gain (dBi).

Figure 10:
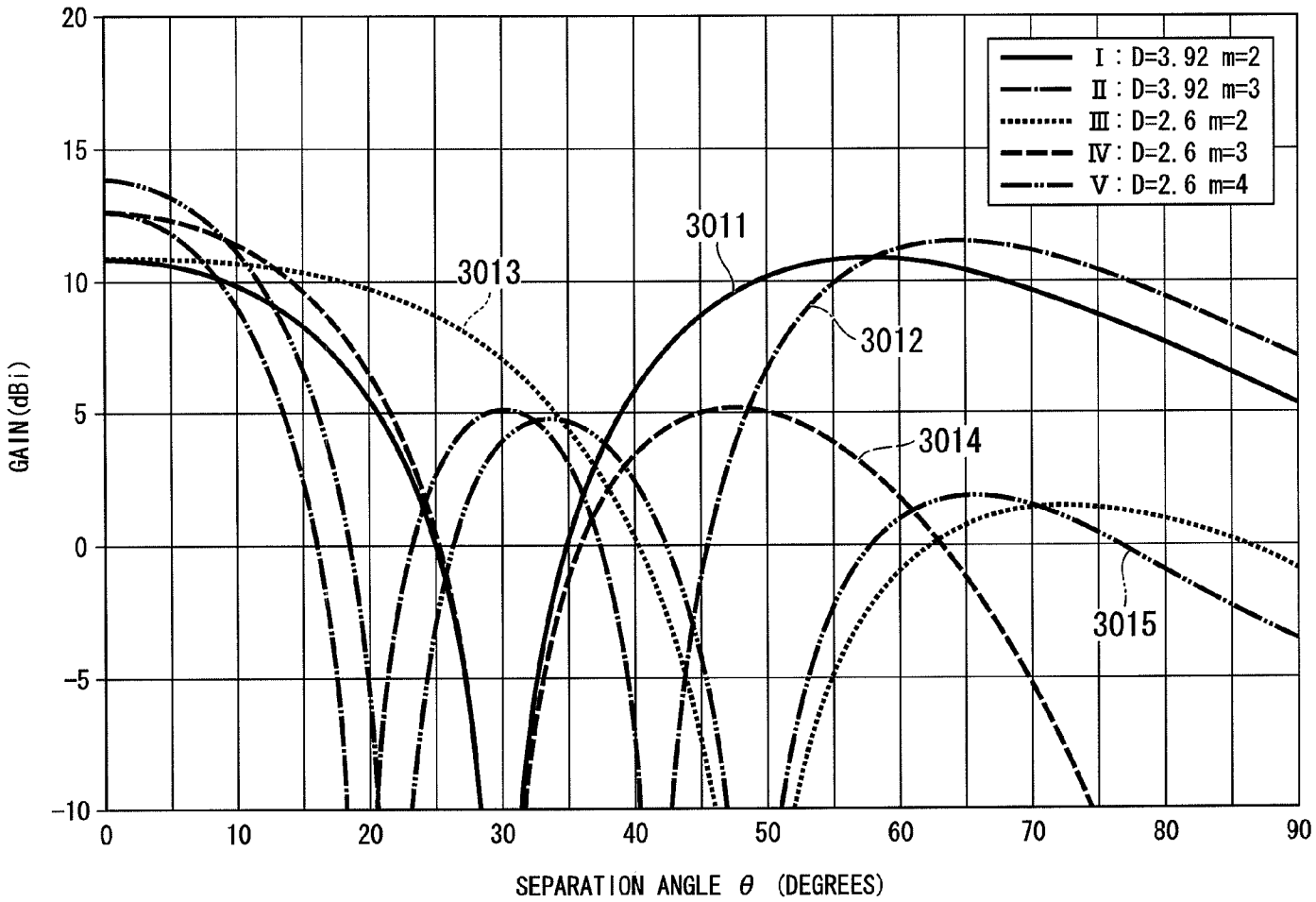
FIG. 10 is a view showing the radiation orientation characteristics (the antenna characteristics) of the transverse plane of the conventional slot array.

FIG. 10 is a view showing the radiation orientation characteristics (the antenna characteristics) of the transverse plane of the conventional slot array. The transverse axis represents the separation angle θ (degrees) from the center and the longitudinal axis represents the gain (dBi).

The graph shown in FIG. 9 will be described.

A characteristic 2011 (I), a characteristic 2012 (II), and a characteristic 2013 (III) are assumed for the receiving antenna.

This example is a case in which the transverse interval P of the antenna is 2λ (=7.84 mm), the transverse aperture width A is 7.4 mm, the longitudinal width of the aperture plane B is 4 mm for the dimension of the horn 33, and the depth H of the horn 33 is 5 mm, in FIGS. 2A, 3B, and 3C.

The characteristic 2011 (I) is of a horn without a bent portion as an exception and a calculated value when the transverse width F of the bottom portion of the horn is 3.6 mm (no stage).

The characteristic 2012 (II) is a calculated value when the transverse width F of the bottom portion of the horn 33 with the bent cross section is 6 mm.

The characteristic 2013 (III) is a calculated value when the transverse width F of the bottom portion of the horn 33 with the bent cross section is 7.1 mm.

Regarding the gain in the structure of the present embodiment, 12.7 dBi (aperture efficiency 77%) is obtained even in the horn without a bent portion (characteristic 2011). In the case of using the horn 33 with the bent cross section (characteristic 2012 and characteristic 2013), a high performance of 13.2 to 13.4 dBi (aperture efficiency 86 to 90%) is obtained.

Regarding the orientation characteristic, if the transverse aperture width A is constant, the side lobe increases when the beam width is narrowed. But because there are no constraints to disposing the aperture in the transmitting antenna 11, it is also possible to obtain the characteristic of low side lobe even with the same narrow beam, by selecting proper dimensions for the transverse aperture width C of the horn, the transverse width F' of the bottom portion, and the depth H'.

As a specific example, a characteristic 2014 (IV) and a characteristic 2015 (V) are assumed for the transmitting antenna 11.

The characteristic 2014 (IV) is a calculated value when the horn 51 has dimensions in which the transverse aperture width C is 14.5 mm, the longitudinal width of the aperture plane B' is 4 mm, the depth H' is 13.5 mm, and the transverse width of the bottom portion F' is 6.5 mm.

The characteristic 2015 (V) is a calculated value when the horn 51 has dimensions in which the transverse aperture width C is 15.7 mm, the longitudinal width of the aperture plane B' is 4 mm, the depth H' is 15 mm, and the transverse width of the bottom portion F' is 6.32 mm.

Meanwhile, the transverse aperture width C, the longitudinal width B' of the aperture plane, the depth H', and the transverse width F' of the bottom portion for the horn 51 of the transmitting antenna 11 represent the lengths of the portions corresponding to the transverse aperture width A, the longitudinal width B of the aperture plane, the depth H, and the transverse width F of the bottom portion for the horn 33 of the receiving antennas 12-1 to 12-N, respectively.

The graph shown in FIG. 10 will be described.

The characteristic 3011 (I) represents the radiation characteristic in the radiation area identical to the horn 33 of the receiving antenna used in the graph shown in FIG. 9.

In FIGS. 8A and 8B, the transverse intervals of the antenna are set equally at P1=2λ. Because the slots 112 are disposed at intervals of λg/2 in the longitudinal direction perpendicular to the transverse direction, the slots 112 of the scope 3001 shown in FIG. 8A (the scope of the portion surrounded by a two-dot chain line in FIG. 8A) are equal to 1 horn made of 1 set of 4 slots.

This 4-element array shows the case of the interval (the transverse interval between the neighboring waveguides 103) D is 3.92 mm (=1λ) shown in FIGS. 8A and 8B.

The characteristic 3011 (I) is a characteristic when the number of linear arrays m is 2, like the example shown in FIGS. 8A and 8B.

The characteristic 3013 (III) is a characteristic when the interval (the transverse interval between the neighboring waveguides 103) D shown in FIGS. 8A and 8B is 2.6 mm and the number of linear arrays m is 2.

The characteristic 3014 (IV) is a characteristic of a 6-element array when the interval (the transverse interval between the neighboring waveguides 103) D shown in FIGS. 8A and 8B is 2.6 mm and the number of linear arrays m is 3.

In the characteristic 3011 (I), the grating lobe of element array appears large.

Compared with this, the side lobe can be made lower in the characteristic 3014 (IV), but the waveguide width becomes narrower, and as it approaches the cut-out dimension (λ/2), characteristic variation is increased by frequency or manufacturing precision. Furthermore, because the elements are closer, mutual coupling between slots 112 increases, and it becomes difficult to obtain stable performance.

Next, the characteristic 3012 (II) and the characteristic 3015 (V) will be described with regard to the transmitting antenna.

The characteristic 3012 (II) is a characteristic of the case that the interval (the transverse interval between the neighboring waveguides 103) D shown in FIGS. 8A and 8B is 3.92 mm (=1λ) and the number of linear arrays m is 3.

The characteristic 3015 (V) is a characteristic of the case in which the interval (the transverse interval between the neighboring waveguides 103) D shown in FIGS. 8A and 8B is 2.6 mm (=1λ) and the number of linear arrays m is 4.

In both of receiving/transmitting signals, especially in a radar antenna performing DBF, because the number of elements is small, the offset point (null) and the overlap point (peak) of the radiation electric field appear conspicuous in the characteristic of the element array, and compared with the radiation in a continuous electric field plane like the horn, a high side lobe is generated.

Figure 11:
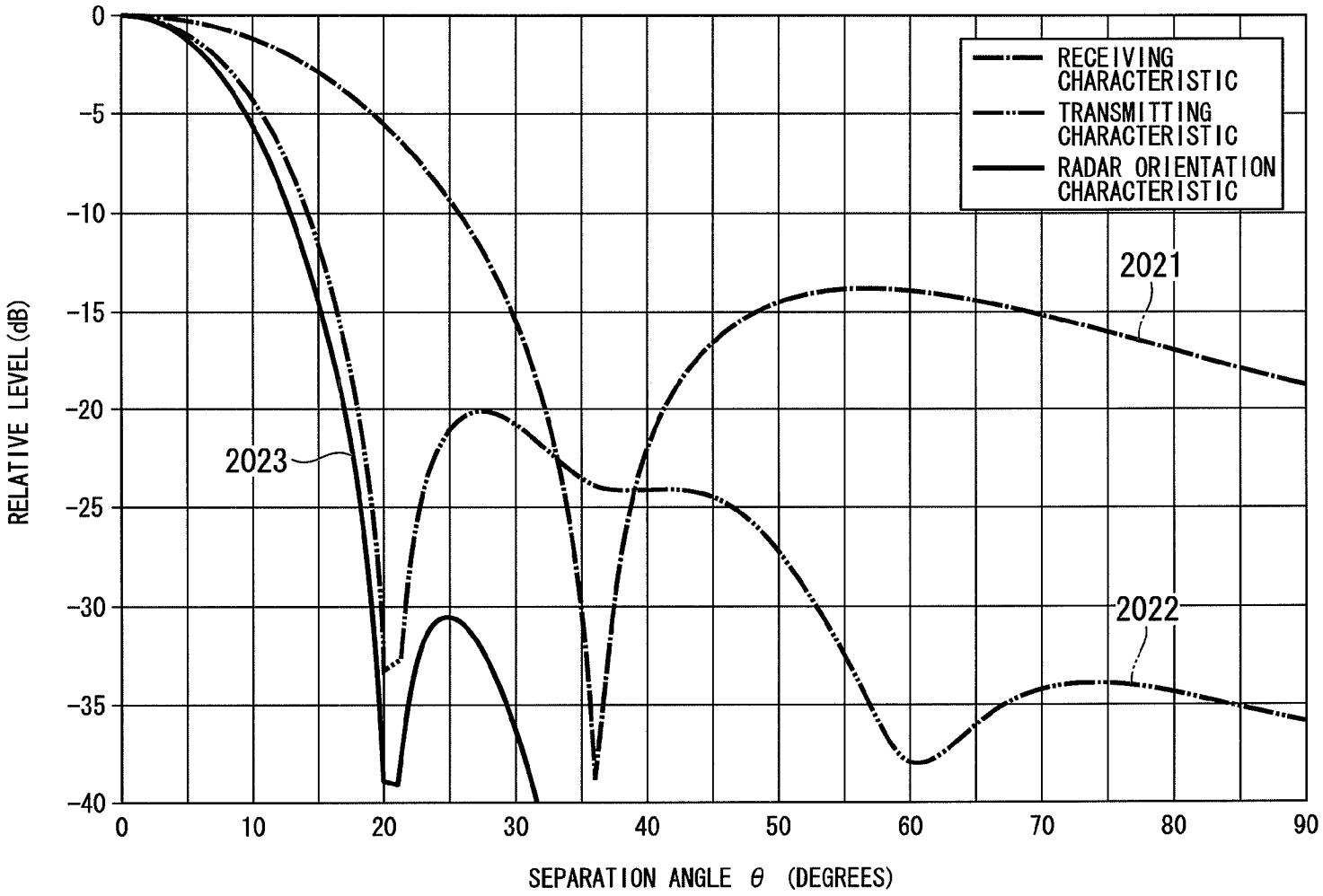
FIG. 11 is a view showing a design example of the radiation orientation characteristics (the antenna characteristics) of the transverse plane of the antenna device (the radar antenna) installed in the on-vehicle radar device according to the embodiment of the present invention.

FIG. 11 is a view showing the design example of the radiation orientation characteristics (the antenna characteristics) of the transverse plane of the antenna device (the radar antenna 1) installed in the on-vehicle radar device according to the embodiment of the present invention. The transverse axis represents the separation angle θ (degrees) and the longitudinal axis represents the relative level (dB).

In this example, the transverse interval P of the antenna is set at 2λ (=7.84 mm).

The receiving characteristic 2021 is the design example in which the horn 33 has dimensions in which the transverse aperture with A is 7.4 mm, the longitudinal width B of the aperture plane is 4 mm, the depth H is 5 mm, and the transverse width F of the bottom portion is 7.1 mm.

The transmitting characteristic 2022 is the design example in which the horn 33 has dimensions in which the transverse aperture with C is 15.7 mm, the longitudinal width B' of the aperture plane is 4 mm, the depth H' is 15 mm, and the transverse width F' of the bottom portion is 6.32 mm.

The radar orientation characteristic 2023 is obtained by multiplying the receiving characteristic 2021 and the transmitting characteristic 2022.

This example is the radar orientation characteristic 2023 and shows a design example aimed at −30 dB or less in the region of the separation angle 19° or more where the grating lobe of DBF appears.

Figure 12:
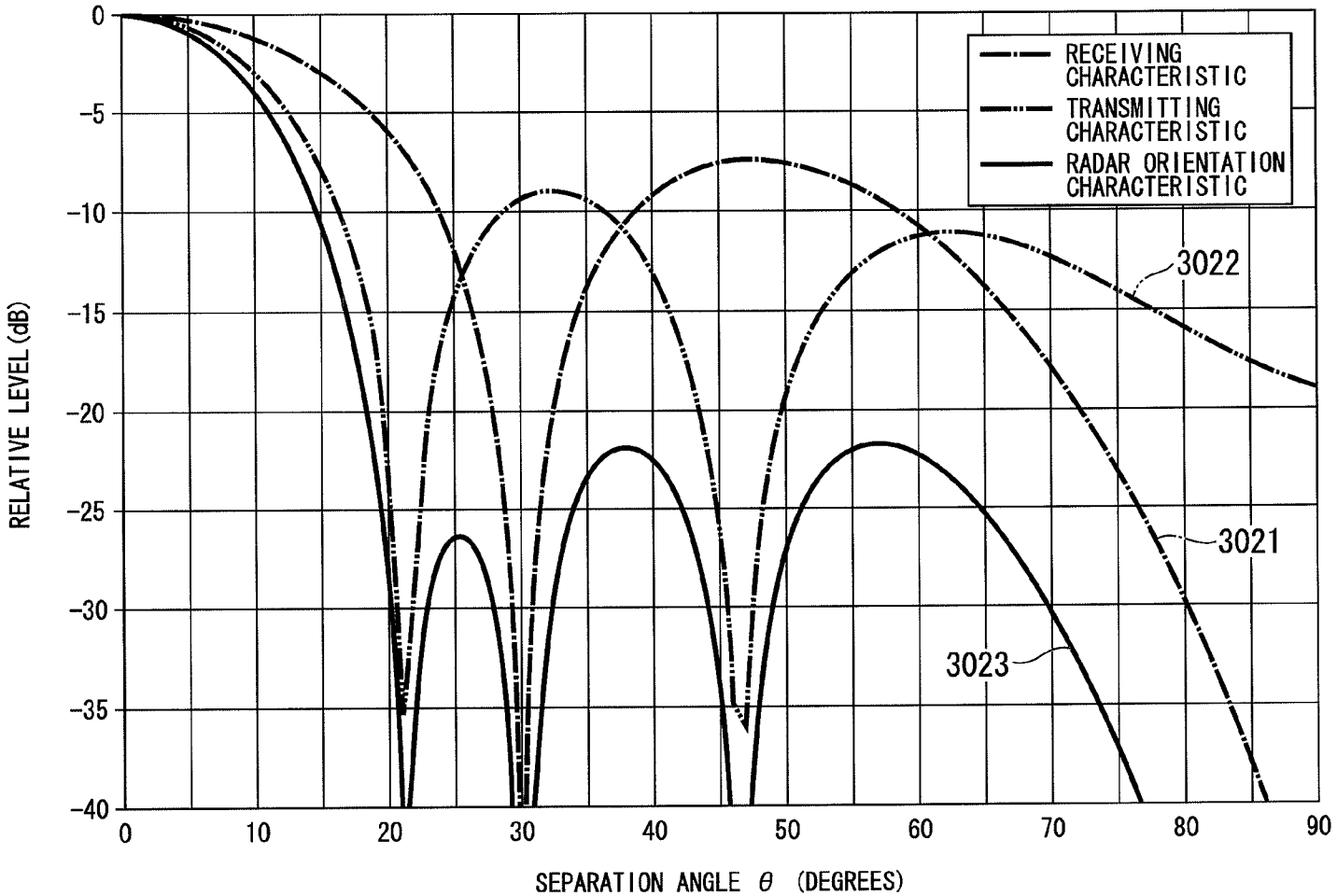
FIG. 12 is a view showing a design example of the radiation orientation characteristics (the antenna characteristics) of the transverse plane of an antenna device (the radar antenna) by the conventional slot array.

FIG. 12 is a view showing a design example of the radiation orientation characteristics (the antenna characteristics) of the transverse plane of an antenna device (the radar antenna) by the conventional slot array. The transverse axis represents the separation angle θ (degrees) from the center and the longitudinal axis represents relative level (dB).

Regarding design specifications, the receiving characteristic 3021 represents a configuration in which the interval (the transverse interval between the neighboring waveguides 103) D shown in FIGS. 8A and 8B is 2.6 mm and the number of linear arrays m is 3. The transmitting characteristic 3022 represents a configuration in which the interval (the transverse interval between the neighboring waveguides 103) D shown in FIGS. 8A and 8B is 2.7 mm and the number of linear arrays m is 4.

The radar orientation characteristic 3023 is obtained by multiplying the receiving characteristic 3021 and the transmitting characteristic 3022.

In this example, although one peak of the receiving characteristic 3021 and the transmitting characteristic 3022 is overlapped on another null to adjust the characteristics thereof, a high side lobe remains if compared with the present embodiment.

Furthermore, in the present embodiment, it is possible to correspond to the design simply by selecting the dimensions of the horns 33 and 51, even in various radar performance requirements. For example, in order to obtain a high resolving power with a small number of receiving systems, it is effective to widen the transverse interval P of the receiving antennas 12-1 to 12-N.

Figure 13:
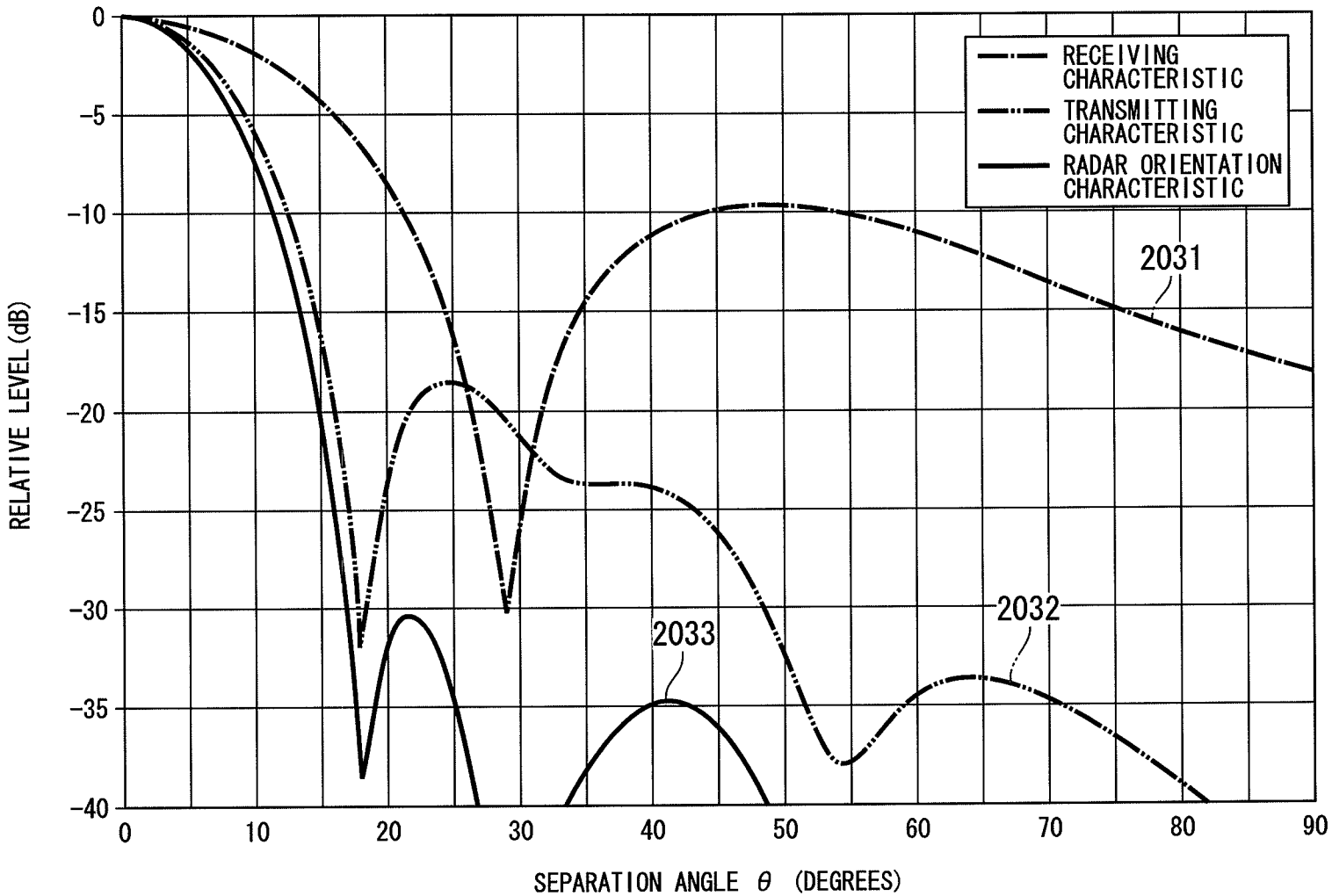
FIG. 13 is a view showing a design example of the radiation orientation characteristics (the antenna characteristics) of the transverse plane when the interval of receiving antennas is widened in the antenna device (the radar antenna) installed in the on-vehicle radar device according to the embodiment of the present invention.

FIG. 13 is a view showing a design example of the radiation orientation characteristics (the antenna characteristics) of the transverse plane when the transverse interval P of the receiving antennas 12-1 to 12-N is widened in the antenna device (the radar antenna 1) installed in the on-vehicle radar device according to the embodiment of the present invention. The transverse axis represents the separation angle θ (degrees) from the center and the longitudinal axis represents the relative level (dB).

In this example, the transverse interval P of the receiving antennas 12-1 to 12-N is 8.5 mm.

The receiving characteristic 2031 is a design example in which the horn 33 has dimensions in which the transverse aperture width A is 8 mm, the longitudinal width B of the aperture plane is 4 mm, the depth H is 6 mm, and the transverse width F of the bottom portion is 7.6 mm.

The transmitting characteristic 2032 is a design example in which the horn 51 has dimensions in which the transverse aperture width C is 17 mm, the longitudinal width B' of the aperture plane is 4 mm, the depth H' is 18 mm, and the transverse width F' of the bottom portion is 6.8 mm.

The radar orientation characteristic 2033 is obtained by multiplying the receiving characteristic 2031 and the transmitting characteristic 2032.

In this case, the grating lobe appears in the angle direction of 17° or more, but also in this region, a low side lobe characteristic of −30 dB or less is obtained.

In the present embodiment, since the transverse aperture width A of the horn 33 of the receiving antennas 12-1 to 12-N can be expanded depending on the transverse interval P of the receiving antennas 12-1 to 12-N, a higher gain is obtained and the null point can be made inside. Furthermore, an expected characteristic can be obtained from the horn 51 of the transmitting antenna 11 simply by increasing the dimensions of the transverse aperture width C and the depth H' by about 3 mm.

<Description of Another Configuration>

Next, side lobe characteristics other than in the transverse direction will be described.

Unnecessary radiation in an inclined direction is disclosed in JP-A-2007-228313.

The conventional slot array also has a cyclical array in the diagonal direction of grid-shape disposition. Therefore, when the interval between slots is widened the grating lobe of the array appears.

Meanwhile, because the structure of the present embodiment has no array in an inclined direction, this problem does not occur.

However, because the longitudinal horn interval is greater than 1λ, the grating lobe of the array appears in the elevation direction. The appearance angle becomes 57° if $\sin^{-1}[\lambda/Q]$ is given with Q being the longitudinal horn interval and Q=4.67 mm. In this direction, the grating lobe level can be suppressed to −15 to −20 dB by the directional decay of the horn itself, and degradation such as lowering the gain of the main beam does not occur.

However, by making the appearance angles of the grating lobe different in receiving/transmitting signs, it is more preferable that these not overlap. When the width of the main beam is about 4°, if the longitudinal intervals (the transverse intervals between the horn and the slot) of the antennas Qr and Qt are made different by about 5%, it is possible to suppress radar directivity to be less than or equal to −40 dB.

Here, the grating lobe is lowered by decreasing the longitudinal intervals Qr and Qt of the horn, and it is preferable in terms of design for the longitudinal intervals Qr and Qt to be narrowed by adding a corresponding number of horns. Therefore, it is necessary to widen the transverse width of the waveguide (the long side width Wa in the example of FIG. 3C).

Meanwhile, when the transverse width (the long side width Wa in the example of FIG. 3C) is greater than or equal to 1λ, unnecessary higher modes can be sent, so it is normally not used. But since the present embodiment employs a bilaterally symmetric structure, the TE20 mode does not occur.

However, it is necessary to block the TE30 mode within the waveguide. Therefore, in the present embodiment, it is possible to choose the transverse width of the waveguide (the long side width Wa in FIG. 3C) greater than or equal to 1λ and less than 1.5λ.

Figure 14:
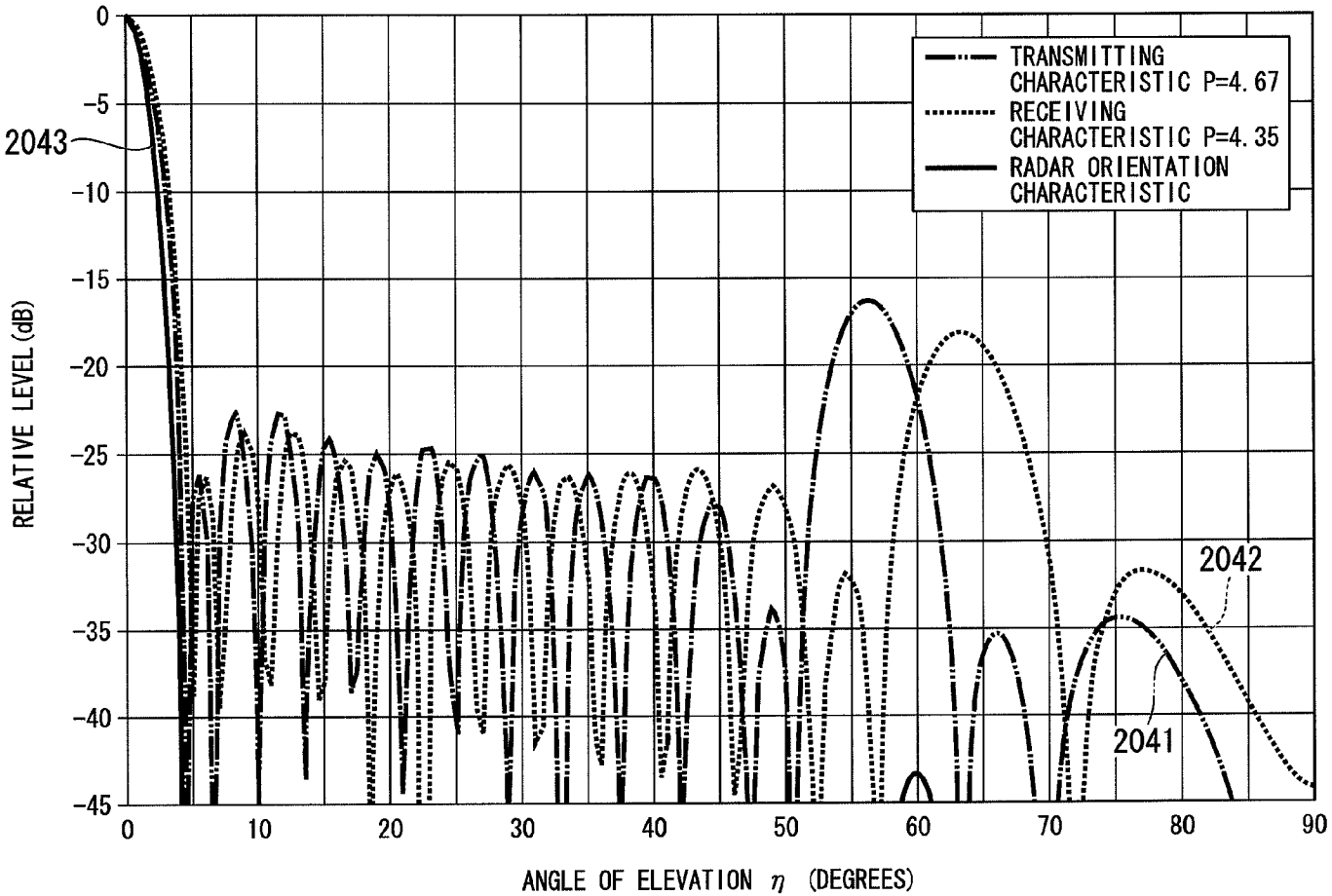
FIG. 14 is a view showing a design example of the radiation orientation characteristics (the antenna characteristics) of the elevation direction of the antenna device (the radar antenna) installed in the on-vehicle radar device according to the embodiment of the present invention.

FIG. 14 is a view showing a design example of the radiation orientation characteristics (the antenna characteristics) of the elevation direction of the antenna device (the radar antenna 1) installed in the on-vehicle radar device according to the embodiment of the present invention. The transverse axis represents the angle of elevation η (degrees) and the longitudinal axis represents relative level (dB).

A transmitting characteristic 2041, a receiving characteristic 2042 and a radar orientation characteristic 2043, which is obtained by multiplying the transmitting characteristic 2041 and the receiving characteristic 2042, are shown.

Here, the transmitting characteristic 2041 represents a configuration in which the antenna interval (that corresponding to the antenna interval P) is 4.67 mm, the transverse width of the waveguide (that corresponding to the long side width Wa) is 3.6 mm, and the longitudinal horn interval Qt is 4.67 mm.

Furthermore, the receiving characteristic 2042 represents a configuration in which the antenna interval P is 4.35 mm, the transverse width (long side width) Wa of the waveguide is 4.5 mm, and the longitudinal horn interval Qr is 4.35 mm.

<Example of DBF Pattern>

Figure 15:
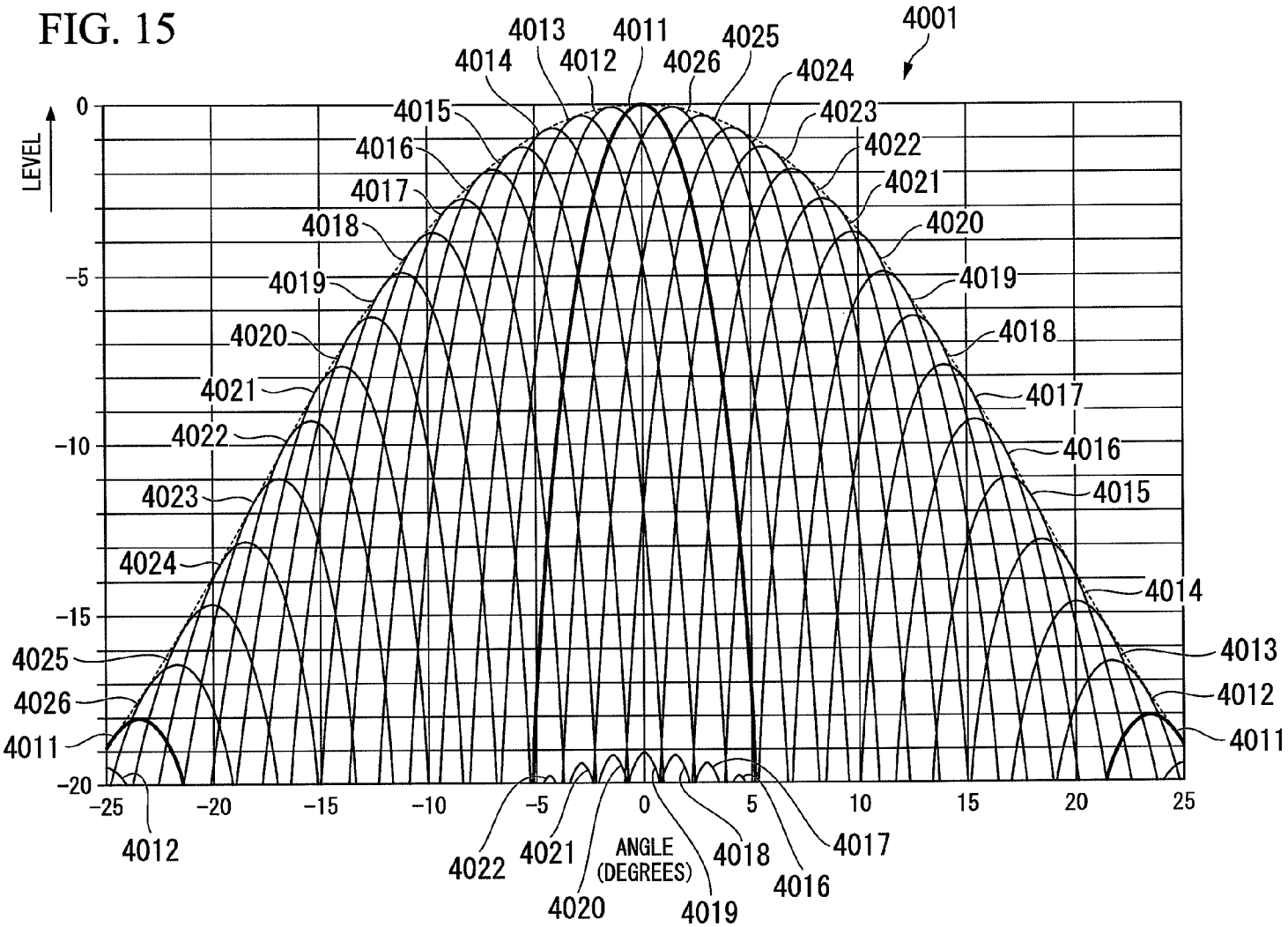
FIG. 15 is a view showing an example of DBF pattern.

FIG. 15 is a view showing an example of a DBF pattern. The transverse axis represents the angle θ (degrees) and the longitudinal axis represents the level.

As shown in FIG. 15, a DBF pattern 4001 having various characteristics is obtained.

Specifically, with a characteristic 4011 corresponding to the angle of θ degrees (front direction) as the center, a plurality of characteristics 4012, 4013, . . . , 4018, 4019, 4020, . . . , 4025, and 4026 located at respective angles gradually being remote from the center are shown.

<Summary of the Embodiments Described Above>

Here, in addition to embodiments described above, as an example in which the horns are added to the waveguide slot array, there is a structure described, for example, in JP-A-H05-209953.

In this structure, the length direction of the waveguide is disposed in the transverse direction to make narrow beams in the transverse direction, which are scanned by rotating the whole of the antenna. Because ship radar is used mainly in the microwave band of an S band or an X band, its actual dimensions are large, and light weight is preferable for practical use. Therefore, the structure in which the horn plate is mounted on the waveguide pipe stock with sheet metal welding is suitable, and if the pyramid horn is added to each slot, the manufacturing becomes complicated and the weight increases a great deal.

Compared with this, the antenna device (the radar antenna 1) installed in the on-vehicle radar device according to the present embodiment is practically small, and an integrated fabrication, for example, by die casting is preferable in order to accommodate many antennas therein.

Here, in the disposition of the antenna device (the radar antenna 1) installed in the on-vehicle radar device according to the present embodiment, if the transverse wall surface is removed, portions with a small metal thickness may be produced in the waveguide portion and the thick portions of the horn part neighbor each other repetitively, so warping or the like can occur during a manufacturing process. Therefore, by installing such a wall surface, the portions with a thin metal thickness are removed, and by letting it have a joist function, a structure suitable to the integral fabrication shown in FIGS. 2A to 2D can be realized.

Furthermore, a high gain can be obtained as the electric field distribution of the plane wave is formed on the aperture plane by the pyramid horns 33 and 51 in terms of the performance of electricity.

Furthermore, by surrounding all sides, the boundary condition of the waveguide is determined and the required higher modes can be controlled.

Accordingly, the antenna device (the radar antenna 1) installed in the on-vehicle radar device according to the present embodiment is used in an on-vehicle radar for millimeter waves of DBF scanning, and a plurality of rows of receiving antennas 12-1 to 12-N and at least one row of transmitting antennas 11 are installed side by side in the transverse direction. Furthermore, the receiving antennas 12-1 to 12-N have a transverse width (aperture width) A of approximately 2λ, and the transmitting antenna 11 has a transverse width C of 3λ or greater as an example.

In addition, in each of the antennas 11, and 12-1 to 12-N, a plurality of rectangular slots 32 in which the waveguide cross section is long in the long side direction are formed at intervals Q of about 1 λg on the long side surface of one rectangular waveguide 31 which is long in the longitudinal direction. Furthermore, the pyramid horns 33 with the bent cross section are added to each of the slots 32.

The pyramid horn 33 with the bent cross section has a transverse width (the width of the bottom portion F) at the bottom portion 33*b* near the slot 32 being 1.5λ or greater in the long side direction of the waveguide 31, and has a shape discontinuously widening including the bent portion in the extending direction of the long side of the slot 32.

In the antenna device (the radar antenna 1) installed in the on-vehicle radar device according to the present embodiment, as an example, the long side width Wa of the rectangular waveguide 31 of at least one transmitting or receiving antenna is 1λ to less than 1.5λ.

The antenna device (the radar antenna 1) installed in the on-vehicle radar device according to the present embodiment prevents radar detection performance from being lowered by interference by securely shielding the leakage between antennas, for example, and obtains low side lobe characteristics in the wide angle range. Therefore, it is possible to dissolve false detection by the grating lobe of DBF.

In the present embodiment, the case of the antenna device (the radar antenna 1) installed in the on-vehicle radar device being applied to the radar performing DBF is shown, but it may be applied to a radar categorized other than a DBF type.

It is also possible to apply the antenna device as shown in the present embodiment to any device other than the on-vehicle radar device.

The number of a plurality of rows (N) of the receiving antennas 12-1 to 12-N may be any value.

In the present embodiment, the case of the transmitting antenna 11 being one row has been described, but as another example, any configuration including a plurality of rows of transmitting antennas may be used.

Furthermore, any number may be used for the number of rows (the number of arrays of longitudinal horns) of the antenna element in one row of the receiving antennas 12-1 to 12-N or one row of the transmitting antenna 11.

While embodiments of the present invention has been described in detail with reference to the drawings in the above, it will be understood that specific configuration is not limited to these embodiments but includes also designs within the scope without departing from the gist of the present invention.

What is claimed is:

1. An antenna array, for transmitting or receiving a radio wave in a predetermined wave band, comprising:

a plurality of waveguides extending toward a first direction; and a plurality of rectangular horns extending toward a direction away from a surface of the plurality of waveguides, wherein the plurality of waveguides are arranged in a row extending toward a second direction perpendicular or substantially perpendicular to the first direction, intervals between adjacent ones of the plurality of waveguides are twice as long as a free space wavelength of the radio wave in the predetermined wave band, a cross section of each of the plurality of waveguides is rectangular with a long side thereof extending toward the second direction and a short side thereof being shorter than the long side thereof;

outer surfaces of the plurality of waveguides, each of which has a width in the second direction, each include a plurality of slots arranged in a row extending toward the first direction, the plurality of slots extending to the outer surfaces;

each of the plurality of slots has a rectangular shape with a short side of thereof extending, toward the first direction and a long side thereof being longer than the short side thereof;

at least two of the plurality of waveguides, which are adjacent to each other, have a same width;

an interval between adjacent ones of the plurality of slots in the first direction is equal or substantially equal to a wavelength of the radio wave in the predetermined wave band in the at least two of the plurality of waveguides;

each of the plurality of slots opens on each of base portions of the plurality of rectangular horns;

each of openings at opposite sides of the base portions of the plurality of rectangular horns include a short side thereof extending toward the first direction and a long side thereof extending toward the second direction, the long side thereof is longer than the short side thereof;

each of the long sides of the openings is longer than each of the long sides of the plurality of slots;

each of the short sides of the openings is longer than each of the short sides of the plurality of slots;

each of the plurality of rectangular horns includes a left face and a right face which oppose each other and which extend toward the first direction, and an upper face and a lower face which oppose each other and extend toward the second direction.

2. The antenna array according to claim 1, wherein each of the plurality of rectangular horns further comprises a pair of overhang portions extending toward a center of the plurality of rectangular horns from the base portions of the left face side and the base portions of the right face, respectively.

3. The antenna array according to claim 1, wherein at least a portion of a surface of the pair of the overhang portions facing the opening approaches toward each of the plurality of waveguides while being adjacent to the plurality of slots.

4. The antenna array according to claim 2, wherein a width of each of the base portions in the second direction is equal to or larger than one and half times the free space wavelength.

5. The antenna array according to claim 1, wherein each of the long sides of the plurality of waveguides is smaller than one and half times the free space wavelength and equal to or larger than half of the free space wavelength.

6. The antenna array according to claim 1, further comprising:

an antenna plate which is a single monolithic member which includes the plurality of rectangular horns at one side thereof and a plurality of grooves at another side thereof, the plurality of slots being located at a bottom of each of the plurality of grooves;

a metal plate arranged at the another side of the antenna plate and closing the plurality of grooves; and a fixing member configured to fix the metal plate to the antenna plate, located between the plurality of slots.

7. The antenna array according to claim 1, wherein at least a portion of the plurality of waveguides are used to transmit the radio wave, while remaining ones of the plurality of waveguides are used to receive the radio wave;

a total number of the plurality of waveguides used to receive the radio wave is larger than a total number of the plurality of waveguides used to transmit the radio wave.

8. The antenna array according to claim 7, wherein each of long sides of the openings of the plurality of rectangular horns included in the plurality of waveguides used to transmit the radio wave is longer than each of long sides of the openings the plurality of rectangular horns included in the plurality of waveguides used to receive the radio wave.

* * * * *